US009314893B2

(12) United States Patent
Montgomery et al.

(10) Patent No.: US 9,314,893 B2
(45) Date of Patent: Apr. 19, 2016

(54) SHARPENING FIXTURE, PORTABLE SHARPENING TOOL AND KIT

(71) Applicants: Stephen A. Montgomery, Bethel, VT (US); Paul Terry, Franklin, NH (US)

(72) Inventors: Stephen A. Montgomery, Bethel, VT (US); Paul Terry, Franklin, NH (US)

( * ) Notice: Subject to any disclaimer, the term of this patent is extended or adjusted under 35 U.S.C. 154(b) by 366 days.

(21) Appl. No.: 13/711,352

(22) Filed: Dec. 11, 2012

(65) Prior Publication Data

US 2014/0162538 A1 Jun. 12, 2014

(51) Int. Cl.
*B24B 3/36* (2006.01)
*B24B 23/00* (2006.01)
*B24B 23/08* (2006.01)

(52) U.S. Cl.
CPC ..... *B24B 3/363* (2013.01)

(58) Field of Classification Search
CPC ..... B24B 3/54; B24B 3/52; B24B 41/066
USPC ..... 451/420, 421, 371, 393, 549, 234, 45; 269/3, 6, 71, 55, 95, 143, 249, 271
See application file for complete search history.

(56) References Cited

U.S. PATENT DOCUMENTS

| | | | | |
|---|---|---|---|---|
| 3,495,361 | A * | 2/1970 | Gebert et al. | 451/421 |
| 6,068,543 | A * | 5/2000 | Renn | 451/67 |
| 6,761,623 | B1 * | 7/2004 | Baker | 451/280 |
| 7,967,666 | B1 * | 6/2011 | Messner | 451/349 |
| 2009/0203298 | A1 * | 8/2009 | Rasmussen | 451/160 |

* cited by examiner

*Primary Examiner* — Joseph J Hail
*Assistant Examiner* — Jon Taylor
(74) *Attorney, Agent, or Firm* — Michael J. Persson; Catherine E. Napjes; Lawson Persson & Weldon Francke

(57) ABSTRACT

The present invention is a blade sharpening fixture, tool and kit for use with logging equipment with a rotary drum that has dozens of staggered blades mounted thereupon. The sharpening tool clamps onto a single blade of the logging equipment while the blade is still mounted on the rotary drum, so that the blade may be sharpened in the field. The sharpening tool includes a sharpening fixture and a grinder. The sharpening fixture includes a blade clamp for clamping onto the blade; a track attached to a sloped surface that can be positioned parallel or perpendicular to the blade; and a grinder connector assembly for securing the grinder securely and slidably to the track.

21 Claims, 13 Drawing Sheets

SHARPENING FIXTURE, PORTABLE SHARPENING TOOL AND KIT

FIELD OF THE INVENTION

The present invention relates to portable sharpening tools, and in particular, to a fixture tool and kit for allowing the sharpening of blades inherent in tree grinding equipment in the field of operation.

BACKGROUND

A tree chipper or wood chipper is a machine used for reducing wood, generally tree limbs or trunks, into smaller woodchips. Among the first commercially available, and still in production today, drum chippers employ mechanisms consisting of a large steel drum powered by a motor, usually by means of a belt. The drum includes a plurality of sharp edged blades or teeth disposed about its outer surface. The drum is mounted parallel to a hopper and spins towards an output chute. The drum also serves as the feed mechanism, drawing the material through as it chips it.

In order for a chipper to perform effectively, the blades need to be sharp. Therefore, when the blades are dull, the equipment is shut down and an operator must remove each bolted-on dull blade and replace them with new, sharp blades. The dull blades are sent to vendors for sharpening. This takes a significant amount of time and also requires that a full set of sharp blades be available.

There are currently few options for sharpening chipper blades without removing them from the drum, but each has significant drawbacks. One such option is the use of a manual blade dresser. This tool includes a sharpening stone mounted at a set angle within a handle. These tools may be used effectively in cases where the blades have not been significantly dulled. However, they require a significant amount of effort on the part of the user and do not produce uniform edges. Further, they expose the user to injury from contact with adjacent blades.

Another option is the "Bevel Buddy" tool sold by Precision Sharpening Devices, Inc. of Erie, Pa. This device consists of a guide that is mounted to a rotary tool, like those sold under the trademark "DREMEL". In operation, the user aligns the guide with the blade and the rotating grinding wheel removes material from the flat back side of the blade. This poses significant drawbacks. First, grinding the flat backside of the blade is not effective at sharpening heavily dulled blades and is only useful at touching up lightly dulled blades. Second, the fact that the guide uses the beveled portion of the blade to guide the grinding wheel means that any lack of uniformity in the beveled surface, as can often occur when the blade is partially damaged, causes a lack of uniformity in the grind itself and a less effective cutting edge. Finally, the device is susceptible to variation based upon the angle that the user holds the tools, again resulting in non-uniform edges.

Therefore there is a need for a device that allows chipper blades to be sharpened quickly in the field without having to remove them from the drum, that does not require a significant amount of effort on the part of the user, that may be used to sharpen heavily dulled blades, that does not expose the user to injury from contact with adjacent blades, that produces uniform edges, and that sharpens the beveled side of the blade.

SUMMARY OF THE INVENTION

The present invention is a blade sharpening tool for use in sharpening an angled cutting surface of a chipper blade, a sharpening fixture that is combined with a grinder to form the blade sharpening tool and a kit including the sharpening fixture and the grinder. The sharpening tool may be applied to an individual dull blade while the blade is still disposed upon the rotary drum of the equipment. The sharpening tool includes a sharpening fixture and a grinder attached to the fixture, which may be sold in kit form.

In its most basic form, the sharpening tool includes a grinder having a grinding wheel and a grinder motor, and a sharpening fixture. The sharpening fixture includes a clamp side and a slide side. Each of the clamp side and the slide side include an attachment portion that allows the clamp side to engage and move linearly relative to the slide side and each includes a sloped surface which is sloped an angle substantially equal to an angle of the angled cutting surface of the blade to be sharpened. The clamp side and the slide side define a blade opening shaped and dimensioned to engage the blade during sharpening. A blade clamp is provided for securely and removably clamping the clamp side and the slide side to the blade. A track is attached to the sloped surface of the slide side of the clamp and a grinder connector assembly is attached to the track. The grinder connector assembly is adapted for holding the grinder in slidable relation to the track such that a plane formed by a flat portion of the grinding wheel is disposed in substantially parallel relation to a plane formed by the sloped surface of the slide portion of the sharpening fixture. The grinder is securely attached to the sharpening fixture via the grinder connector assembly.

In a preferred embodiment, the blade clamp of the sharpening fixture is a latch toggle clamp that includes hooks disposed upon the clamp side of the sharpening fixture. First and second "L" base plates are disposed upon the slide side of the sharpening fixture such that a portion of the first and second "L" base plates are flush with the slide side of the sharpening fixture and a portion of the first and second "L" base plates extend perpendicularly out from the slide side of the sharpening fixture such that the portions of the first and second "L" base plates that extend perpendicularly out from the slide side of the sharpening fixture are flush with one another. A clamp handle is provided and includes a handle end and a pivot end. A clamp handle screw extends through the portions of the first and second "L" base plates that extend perpendicularly out from the slide side of the sharpening fixture and the pivot end of the clamp handle, and a bolt extends through the clamp handle such that the bolt is parallel to the clamp handle screw. A "U" piece including first and second threaded sides and a closed side is provided. The "U" piece is dimensioned such that the closed side is sized and dimensioned to be caught by the hooks disposed upon the clamp side of the sharpening fixture. The "U" piece is caught by the hooks, the first and second threaded sides extend through the bolt on either side of the pivot end of the clamp handle. Finally, at least two washers are sized and dimensioned to fit securely onto the first and second threaded sides of the "U" piece so as to hold the "U" piece securely in place through the bolt.

In the preferred sharpening tool, the grinder connector assembly of the sharpening fixture includes a slide disposed in movable relation to the track such that it may slide back and forth thereon. An extender is attached to the sliding piece, an arm attached to the extender, and a grinder connector is attached to the arm and is dimensioned and shaped for attachment to the grinder. In the preferred embodiment, the arm of the grinder connector assembly is substantially L-shaped and is adjustably attached to the extender such that an adjustment of said arm allows the height of the grinder to be adjusted. In some embodiments, the extender is adjustably attached to the slide such that the grinding wheel of the grinder may be positioned at an angle relative to the blade. In still other embodiments, the grinder connector assembly of the sharpening fixture also includes a grinder support attached to the extender.

Some embodiments of the sharpening fixture include a uni-mount attached to the grinder connector assembly. The uni-mount is shaped and dimensioned to be attached to the grinder and includes a first threaded opening, a second threaded opening, and a threaded plug. The first threaded opening and second threaded opening are each dimensioned to mate with said threaded plug and a threaded bolt extending from a handle of the grinder, which allows the handle to be positioned on a side desired by the user. In embodiments utilizing a uni-mount, it is preferred that the grinder connector be reversible.

In a preferred embodiment of the sharpening tool, the slide side of the sharpening fixture includes a plurality of track positioning holes and at least one track bolt for holding the track in a certain position with relation to the slide side of the sharpening fixture when the track bolt is secured through the track and one of the track positioning holes. It is also preferred that the plurality of track positioning holes includes a first plurality of track positioning holes and a second plurality of track positioning holes disposed in perpendicular relation to the first plurality of track positing holes.

The present invention also includes a blade sharpening tool for use in sharpening an angled cutting surface of a blade that includes the sharpening fixture attached to a grinder having a wheel and a grinder motor.

Finally, the present invention includes a blade sharpening kit for use in sharpening an angled cutting surface of a blade that includes the sharpening fixture and a grinder having a wheel and a grinder motor to which the sharpening fixture is dimensioned to be attached.

Therefore it is an aspect of the present invention to provide a blade sharpening tool that may be used to sharpen dull blades of tree grinding equipment on site, in the field.

It is a further aspect of the present invention to provide a blade sharpening tool that may be adjusted to sharpen blades of different sizes.

It is a further aspect of the present invention to provide a blade sharpening tool that may sharpen the blade by grinding both horizontally and vertically across the dull blade.

It is a further aspect of the present invention to provide a blade sharpening tool that does not require a significant amount of effort on the part of the user.

It is a further aspect of the present invention to provide a blade sharpening tool that may be used to sharpen heavily dulled blades.

It is a further aspect of the present invention to provide a blade sharpening tool that does not expose the user to injury from contact with adjacent blades.

It is a further aspect of the present invention to provide a blade sharpening tool that produces uniform edges.

It is a further aspect of the present invention to provide a blade sharpening tool that sharpens the beveled side of the blade.

These aspects of the present invention are not meant to be exclusive and other features, aspects, and advantages of the present invention will be readily apparent to those of ordinary skill in the art when read in conjunction with the following description and accompanying drawings.

DETAILED DESCRIPTION

Figure 1A:
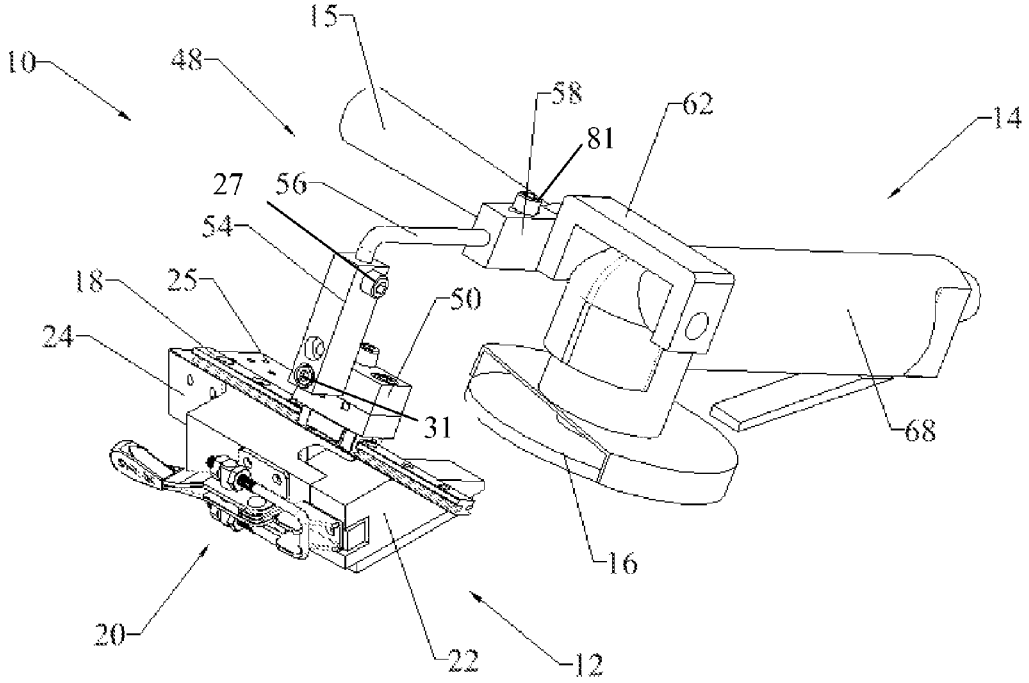
FIG. 1A is a perspective view of the sharpening tool of the present invention with the track parallel to where a blade would be engaged.
Figure 1B:
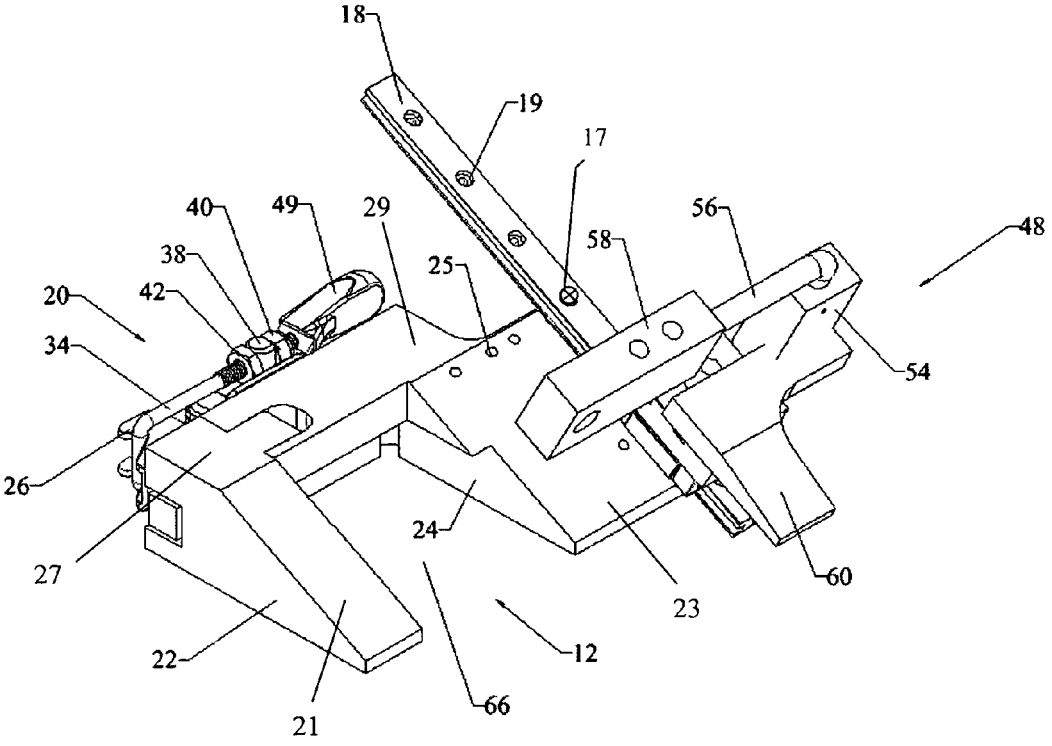
FIG. 1B is a perspective view of sharpening fixture of the present invention.

Referring first to FIGS. 1A and 1B, perspective views of the sharpening tool 10 and sharpening fixture 12 of the present invention are shown. Sharpening tool 10 includes sharpening fixture 12 and grinder 14 that attaches to the sharpening fixture by grinder connector assembly 48.

Grinder 14 is preferably a rotating disc type grinder that includes a handle 15, a grinder motor 68, and a grinder wheel 16. It is preferred that grinder 14 be pneumatically or hydraulically powered, like standard chippers in the industry but, in some embodiments, grinder 14 may be powered electrically. Grinder 14 is an integral part of the sharpening tool 10 and both the grinder 14 and sharpening fixture 12 may be sold as an integrated sharpening tool 10. However, it is recognized that the sharpening fixture 12 may be sold separately from the grinder 14 or the grinder 14 and sharpening fixture 12 may be sold in kit form for assembly into the sharpening tool 10.

As shown in FIG. 1B, sharpening fixture 12 is shaped and dimensioned to clamp around the blade 80 to be sharpened. Sharpening fixture 12 includes clamp side 22 and slide side 24, which are separate pieces that are drawn together by blade clamp 20. Blade clamp 20 allows the size of blade opening 66 to be adjusted for different sized blades 80. The preferred blade clamp 20 is described in detail below with reference to FIGS. 2A and 2B.

Figure 4A:
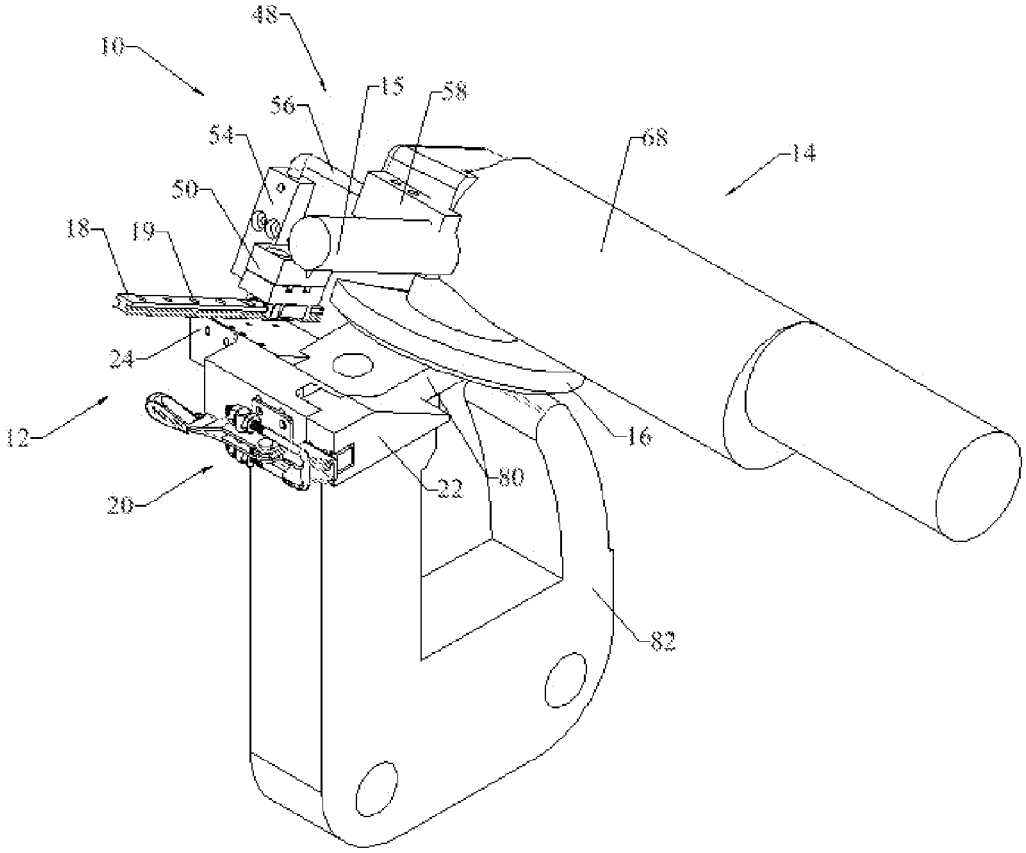
FIG. 4A is a perspective view of the sharpening tool of the present invention applied to a blade, with the track perpendicular to the blade.
Figure 4B:
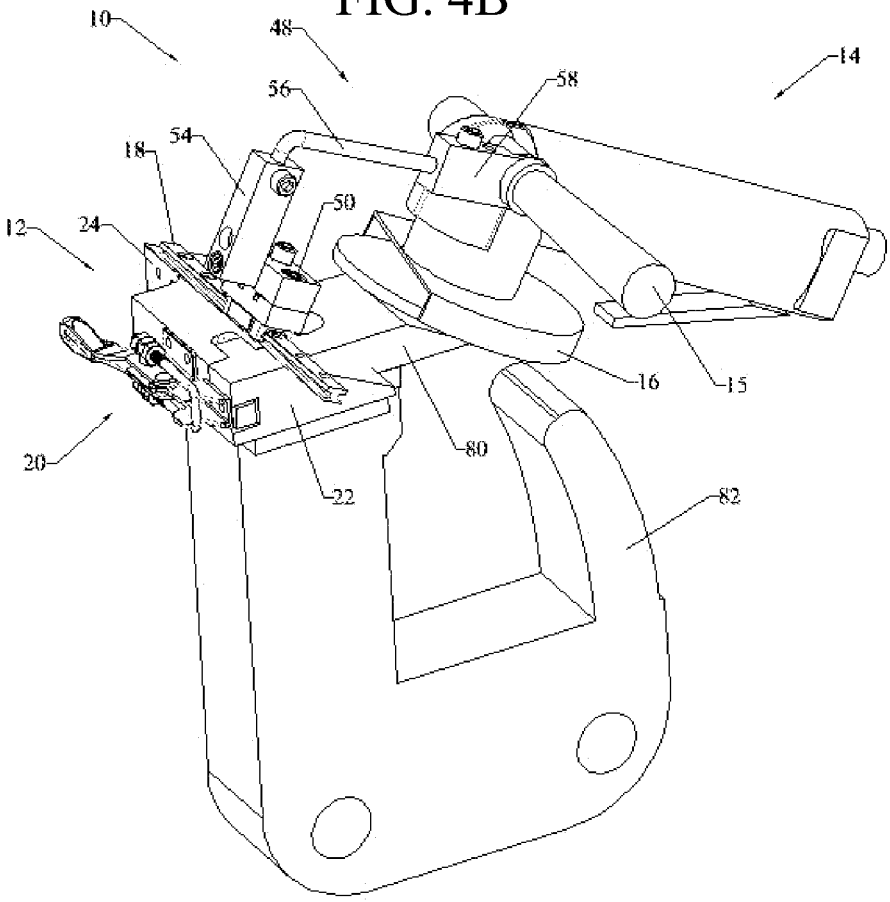
FIG. 4B is a perspective view of the sharpening tool of the present invention applied to a blade, with the track parallel to the blade.

Blade opening 66 is formed between sloped surfaces 21, 23 of clamp and slide sides 22, 24 and is where the blade 80 to be sharpened, shown in FIGS. 4A and 4B, will be placed during sharpening. Sloped surfaces 21, 23 are sloped at substantially the same angle as that of the sharpened edge of blade 80. Track 18 is attached to sloped surface 23 of the slide side 24 of sharpening fixture 12. Track 18 may be swiveled ninety degrees (90°) so that it is either parallel to blade 80 to be sharpened, or perpendicular to it. In FIG. 1A, track 18 is parallel to where blade 80 would be placed in blade opening 66. In FIG. 1B, track 18 is perpendicular to where blade 80 would be placed in blade opening 66. Slide side 24 of sharpening fixture 12 includes track positioning holes 25. Track positioning holes 25 allow track 18 to be positioned with respect to slide side 24. A track bolt 17 is placed through one of the track slots 19 of track 18 and one of the track positioning holes 25 of slide side 24 to allow for this positioning and securing of track 18 with respect to slide side 24. In addition to track 18 being positionable either parallel or perpendicular, as described above, track 18 may be positioned with the length of track 18 extending more or less in a certain direction.

Grinder connector assembly 48 holds the grinder 14 securely to track 18. The preferred grinder connector assembly 48 includes slide 50, extender 54, arm 56, and grinder connector 58. Slide 50 is slidable along the length of track 18. When track 18 is in the perpendicular position, grinder wheel 16 of grinder 14 may be moved vertically up and down over blade 80 to be sharpened. When track 18 is in the parallel position, grinder wheel 16 of grinder 14 may be moved horizontally from side to side across blade 80 to be sharpened. Regardless of its position, the fact that track 18 is mounted to the sloped surface 23 means that the grinding wheel 16 of the grinder 14 will likewise be positioned at the same angle as that of the sloped surface 23, allowing this angle to be ground onto the edge of the blade 80. This relationship is shown in detail in FIG. 3B.

Extender 54 is affixed to slide 50. Arm 56 is preferably L-shaped with one portion adjustably disposed within an opening in extender 54 leg and the other portion affixed to grinder connector 58, which is preferably a clamp type connector that attaches to handle 15 of grinder 14. The height of the grinder 14 relative to the sharpening fixture 12 is adjusted by loosening height screw 27, moving arm 56 upward or downward within the extender 54, and tightening the height screw 27. In some embodiments, the arm 56 includes a plurality of notches (not shown) therein to allow the height screw 27 to affirmatively locate the grinder 14 in a fixed position.

The extender 54 of FIG. 1A also includes tilt positioning screw 31 that allows the extender 54 and, consequently, the grinder 14 and grinder wheel 16 to be tilted into a slightly non-perpendicular position. The tilting of the grinder wheel 16 is preferred in some application in order to limit the amount of contact between the grinder wheel 16 and the blade to be sharpened. However, in some embodiments, the tilt positioning screw 31 is eliminated, the extender 54 is fixedly attached to the slide in a perpendicular position and any tilting of the grinding wheel is accomplished by rotating the portion of the arm 56 that connects to the grinder connector 58.

Figure 1C:
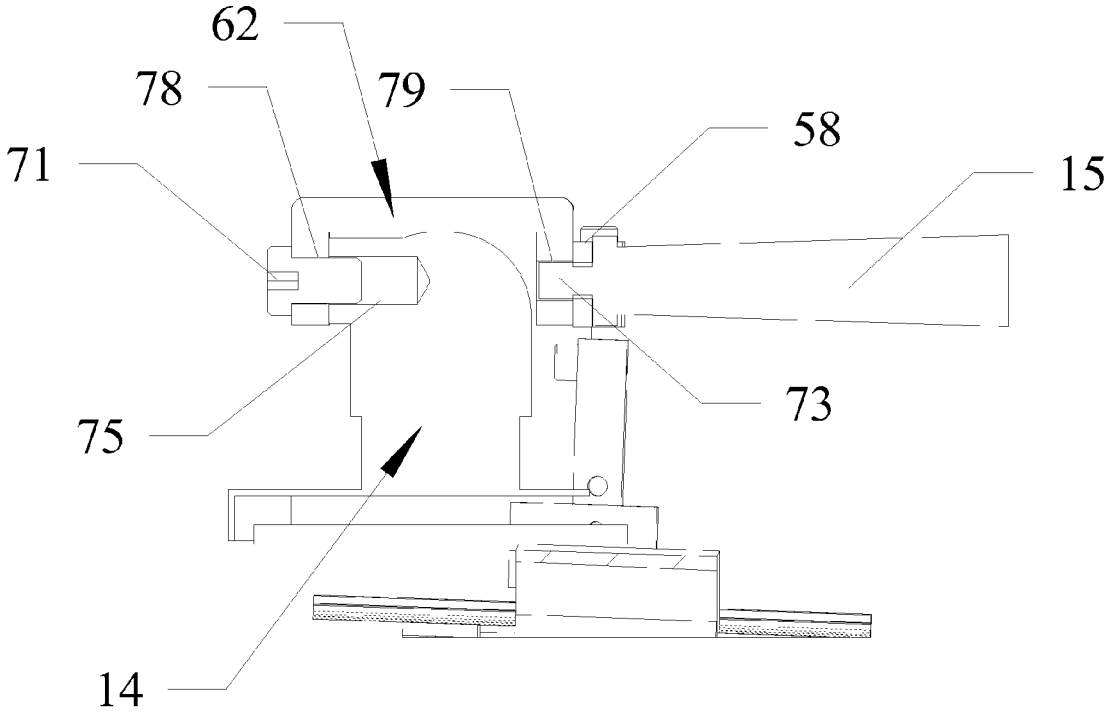
FIG. 1C is a cut away view of the grinder connector assembly showing the preferred grinder uni-mount.

In the embodiment of FIG. 1A, grinder connector assembly 48 also includes grinder uni-mount 62 attached to grinder connector 58. Grinder uni-mount 62 is shown in greater detail in FIG. 1C and is used when grinder 14 only has a single mounting hole 75 for handle 15 and allows the handle 15 to be positioned on either side of the grinder 14. Grinder uni-mount 62 includes a pair of threaded openings 78, 79 that are shaped and dimensioned to mate with the threaded bolt 73 at the end of handle 15 of the grinder. A threaded plug 71 is disposed within the threaded opening 78, 79 opposite the handle. As shown in FIG. 1C, the threaded plug 71 is disposed through the opening 78 and partially threaded into the mounting hole 75 of the grinder 14. However, the position of the handle 15 and plug 71 may be reversed if the operator prefers this position. Grinder connector 58 is disposed between the handle 15 and uni-mount 62. Grinder connector 58 preferably includes rotation screw 81 that allows the grinder connector 58 to be rotated one hundred and eighty degrees (180°) relative to the arm 56 when the handle 15 is mounted on a different side of grinder 14.

Figure 2A:
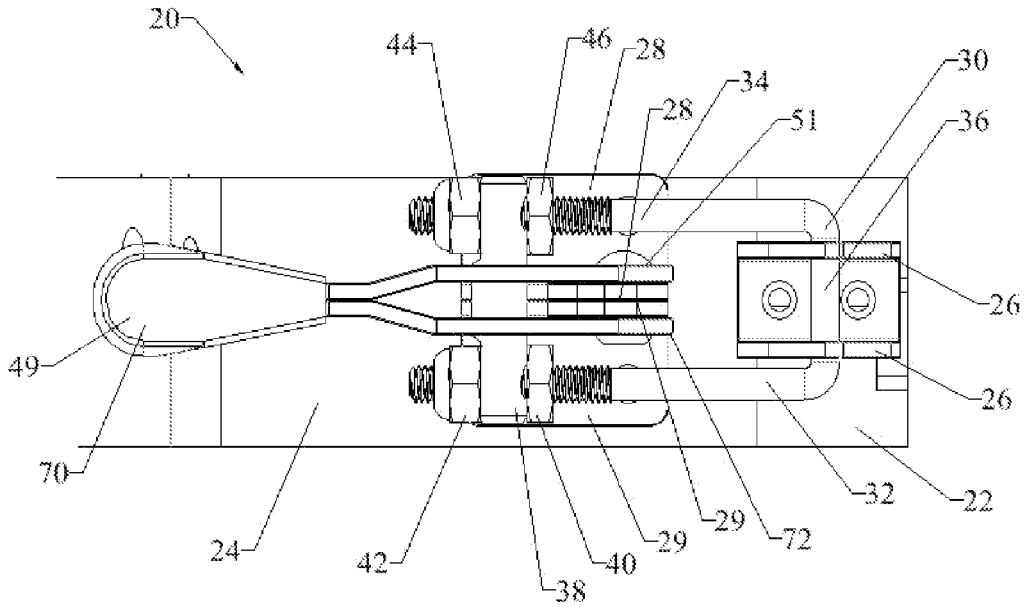
FIG. 2A is a rear detail view of the preferred blade clamp of the sharpening fixture of the present invention.
Figure 2B:
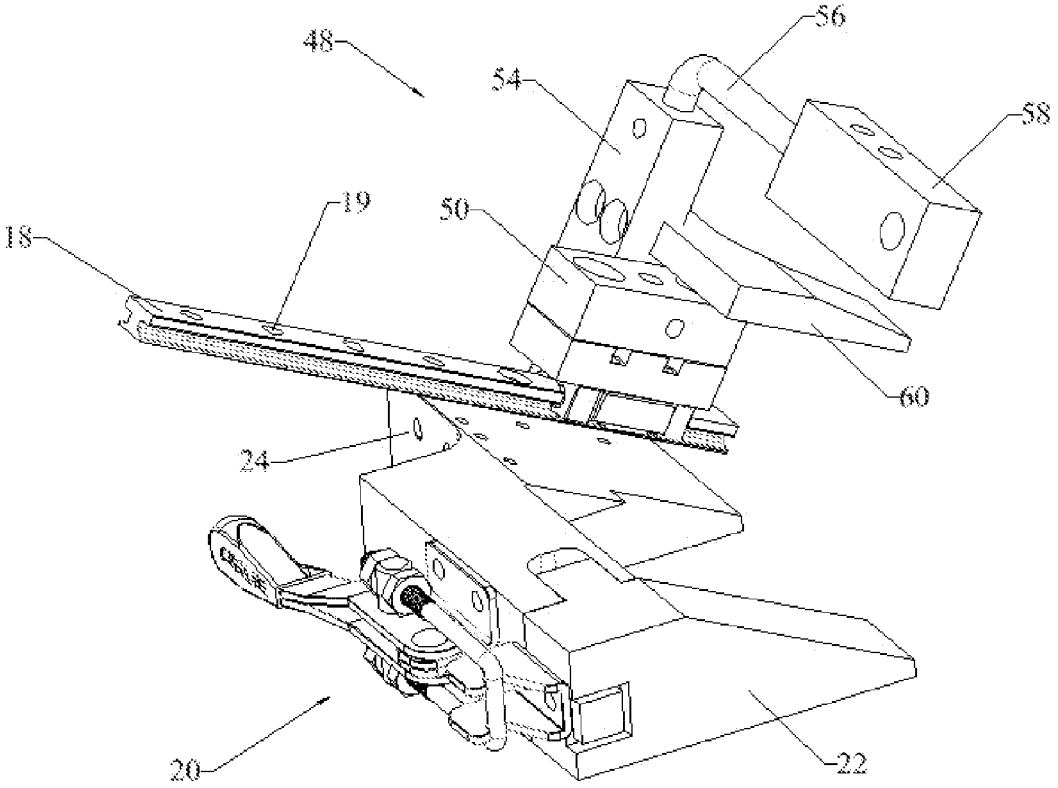
FIG. 2B is a rear detail of the preferred sharpening fixture of the present invention showing the blade clamp.

In other embodiments, such as that shown in FIG. 1B and FIG. 2B, grinder connector assembly 48 also include grinder support 60. Grinder support 60 is affixed to extender 50 and is positioned so that grinder motor 68 rests upon grinder support 60. Some embodiments include both grinder uni-mount 62 and grinder support 60.

Although the preferred grinder connector assembly 48 has been described in detail above, it is understood that grinder connector assembly 48 may take many forms and may attach to the grinder motor 68, or other parts of the grinder 14, provided such connection securely affixes the grinder 14 in a set position relative to the sharpening fixture 12.

Now referring to FIGS. 2A and 2B, a detail of the preferred blade clamp 20 is provided. Blade clamp 20 allows clamp and slide sides 22, 24 of sharpening fixture 12 to be secured closer or farther apart as necessary to attach the sharpening fixture 12 to the blade 80 to be sharpened. The preferred blade clamp 20 is of a type commonly referred to as a "latch toggle clamp" and includes hooks 26, first and second "L" base plates 28, 29, clamp handle 49 with handle end 70 and pivot end 72, clamp handle screw 51, "U" piece 30 with closed side 36 and first and second threaded sides 32, 34, bolt 38, and washers 40, 42, 44, and 46. Hooks 26 are affixed to clamp side 22 of sharpening fixture 12 and are sized and dimensioned so as to be able to catch "U" piece 30. First and second "L" base plates 28, 29 are affixed to slide side 24 of sharpening fixture 12. One side of each "L" shape of first and second "L" base plates 28, 29 is affixed to and flush with slide side 24 of sharpening fixture 12. The other side of each "L" shape of first and second "L" base plates 28, 29 extends perpendicularly away from slide side 24 and is positioned so that these sides extending away are flush with each other. Both the portions of first and second "L"base plates 28, 29 that are flush with slide side 24 and the portions that extend perpendicularly away from those flush portions are labeled in FIG. 2A. Clamp handle 49 is attached to these extending sides of first and second "L" base plates 28, 29 at pivot end 72 of clamp handle 49 by clamp handle screw 51, which extends through both extending sides of first and second "L" base plates 28, 29, as well as pivot end 72 of clamp handle 49, which encloses both extending sides of first and second "L" base plates 28, 29.

Handle end 70 of clamp handle 49 may be moved on the axis of clamp handle screw 51 to loosen or tighten the elements of blade clamp 20 as necessary. When clamp handle 49 is pivoted to be tight around the extending sides of first and second "L" base plates 28, 29, bolt 38 may be passed through handle clamp 49. Then, "U" piece 30 may be placed so that its closed side 36 is caught by hooks 26 on clamp side 22 of sharpening fixture 12 and its first and second threaded sides 32, 34 are on either side of clamp handle 49, which, in turn, surrounds the extending sides of first and second "L" base plates 28, 29. The stroke may be adjusted by loosening or tightening nuts 42, 44, which allow the "U" piece to move back and forth. The stroke is typically adjustable by approximately one inch and longer or shorter "U" pieces 30 may be substituted if necessary. First and second threaded sides 32, 34 of "U" piece 30 also pass through bolt 38 on either side of clamp handle 49. At least washers 42 and 44 are then tightened around the threading of first and second threaded sides 32, 34 to secure blade clamp 20 in the required position for a certain sized blade. It is preferred that washers 40, 46 are also included on the other side of bolt 38 for further securing. The threading on first and second threaded sides 32, 34 therefore allow the elements of blade clamp 20 to be secured to one another through a range of blade opening 66 sizes.

Although FIGS. 2A and 2B show the preferred blade clamp 20, it is recognized that the blade clamp 20 may be any art recognized clamping means for securing the sharpening fixture 10 to the blade. For example, the slide side 24 and clamp side 22 may be drawn together by one or more threaded bolts disposed through each side 22, 24, or disposed in the same position as the preferred blade clamp 20 in FIGS. 2A and 2B. Therefore, the blade clamp 20 should not be seen as being limited to the preferred embodiment of FIGS. 2A and 2B.

Figure 6A:
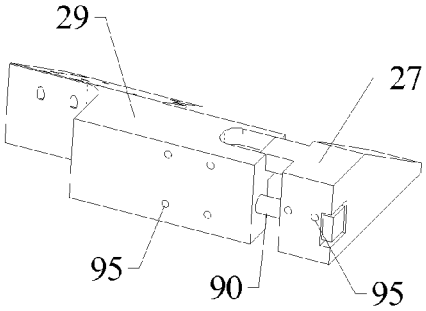
FIG. 6A is a rear perspective view of the sharpening fixture of the present invention with the blade clamp and slide removed.
Figure 6B:
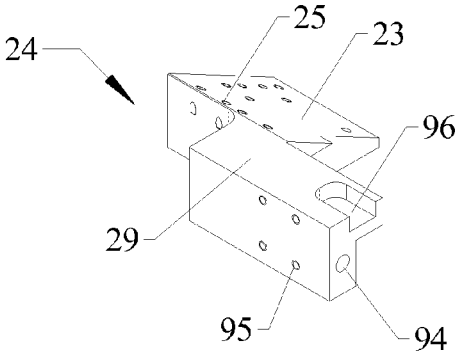
FIG. 6B is a perspective view of the slide side of the sharpening fixture of FIG. 6A with the blade clamp and track removed.
Figure 6C:
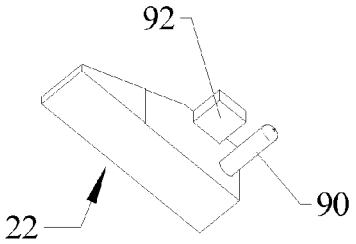
FIG. 6C is a perspective view of the clamp side sharpening fixture of FIG. 6A with the blade clamp and track removed.

As shown in FIGS. 6A-6C, the blade clamp 20 is preferably secured to the rear surfaces of the clamp side 22 and the slide side 24 of the sharpening fixture 10 by a series of threaded holes 95 in the rear of the clamp side 22 and slide side 24. The clamp side 22 preferably includes a guide pin 90 that is dimensioned to mate with a receiving hole 94 in slide side 24, and a rectangular boss 92 that is dimensioned to mate with a rectangular pocket 96 in the top surface 29 of the slide side 24. The guide pin 90 and rectangular boss 92 allow the clamp side 22 to move laterally with respect to the slide side 24 to accommodate blades of different widths. It is recognized that, although the guide pin 90 and rectangular boss 92 are the preferred means for aligning and adjusting the distance between the clamp side 22 and the slide side 24, other such means will be recognized by those of skill in the art and the invention should not be seen as being limited to the preferred embodiments shown herein.

Figure 3A:
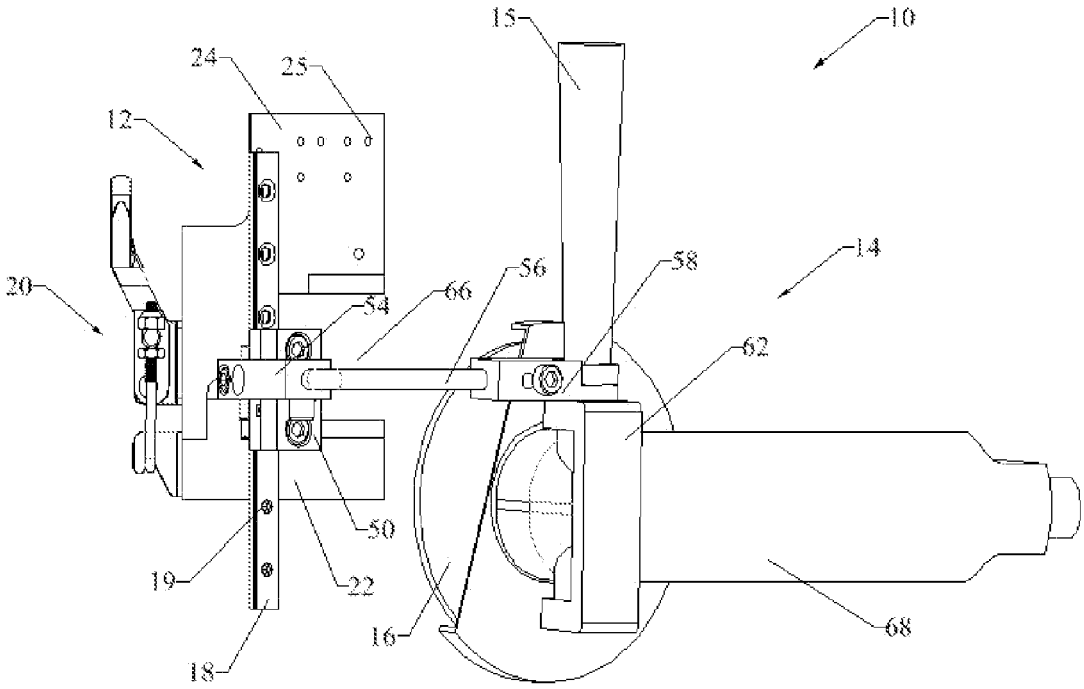
FIG. 3A is a top down view of the sharpening tool of the present invention.
Figure 3B:
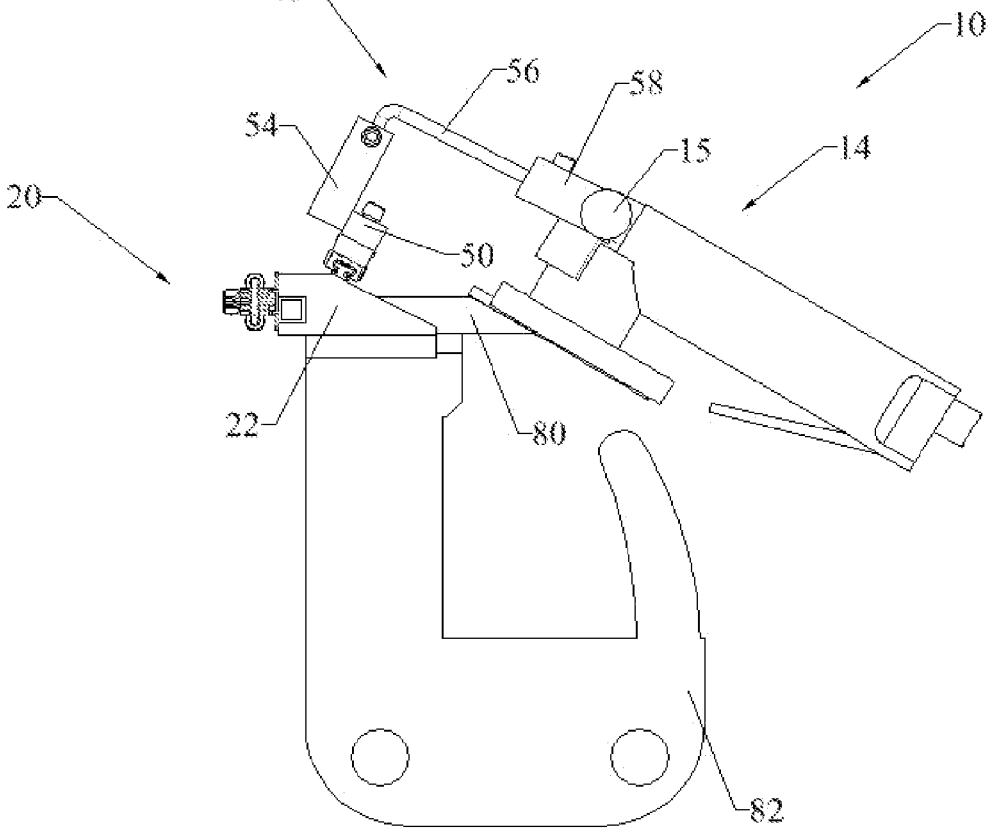
FIG. 3B is a side view of the sharpening tool of the present invention attached to a chipper blade.

Now referring to FIGS. 3A and 3B, top down and side views, respectively, are shown of sharpening tool 10. FIG. 3A shows sharpening tool 10 in isolation. FIG. 3B shows sharpening tool 10 applied to blade 80. In FIG. 3B, one can see that clamp side 22 of sharpening fixture 12 is angled so as to mimic the angle of blade 80. Although not visible in this view, slide side 24 is similarly angled. As discussed above, this allows grinder wheel 16 to easily move across or up and down blade 80 at the desired sharpening angle.

Figure 5A:
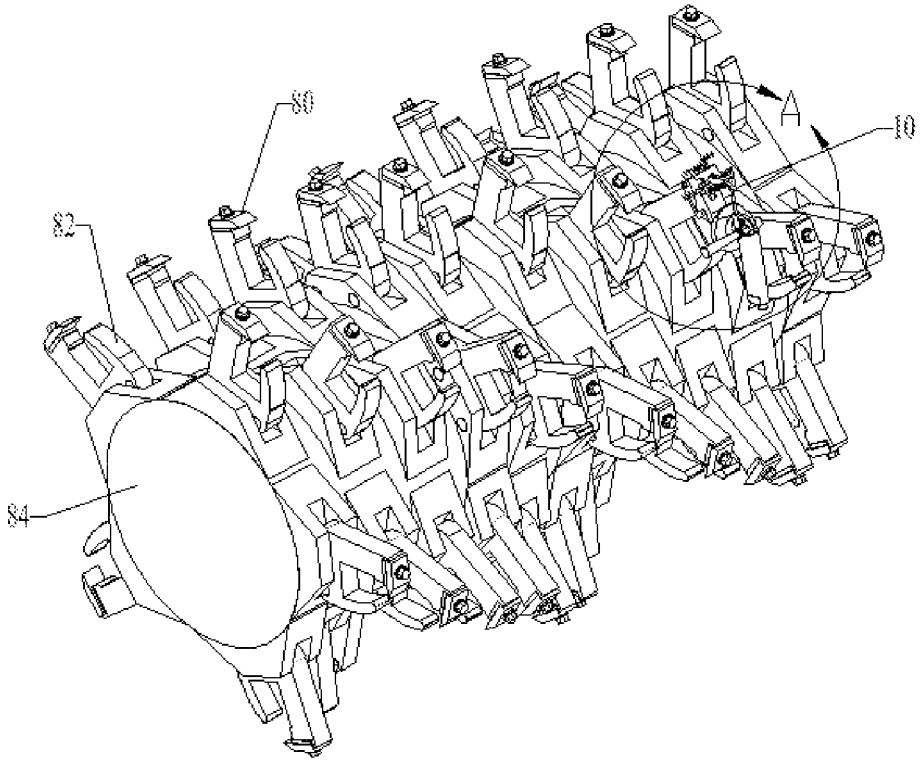
FIG. 5A is a perspective view of the sharpening tool of the present invention positioned on a blade mounted on a rotary drum.
Figure 5B:
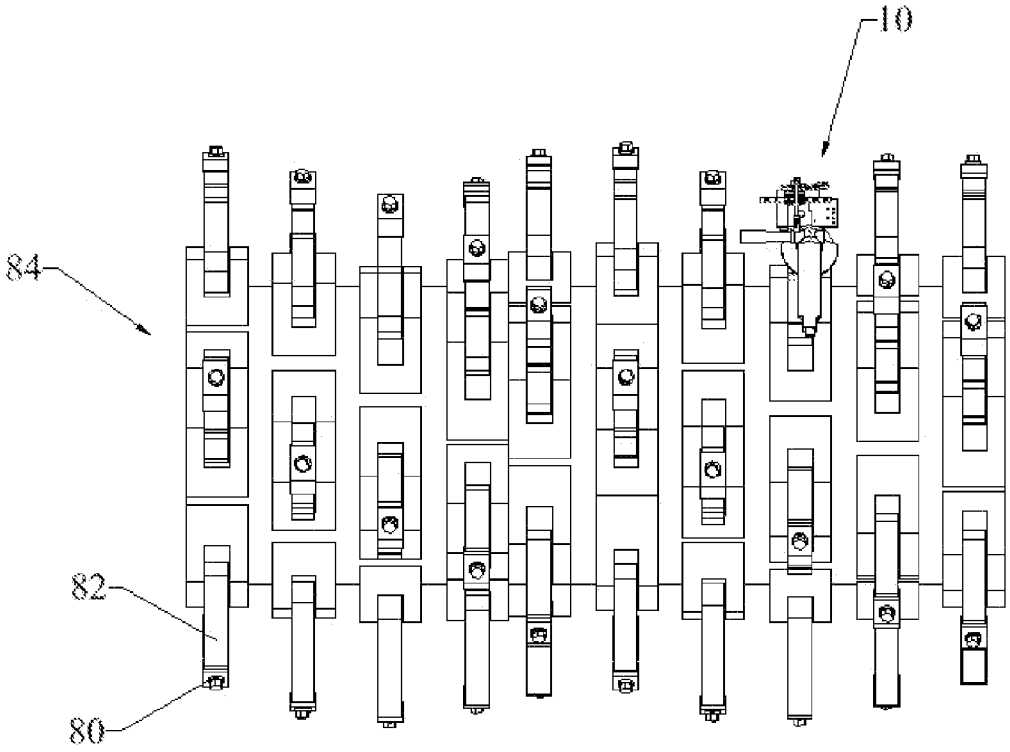
FIG. 5B is a front view of the sharpening tool of the present invention positioned on a blade mounted on a rotary drum.

Referring now to FIGS. 4A and 4B, perspective views of sharpening tool 10 applied to blade 80 are shown. Blade 80 is attached to blade holder 82, which is in turn attached to rotary drum 84 of a drum chipper, as shown in FIGS. 5A and 5B. Sharpening tool 10 may be applied directly to a dull blade 80 still attached to rotary drum 84. In FIG. 2A, track 18 is in the perpendicular position so that grinder wheel 16 may be moved up and down over blade 80. In FIG. 2B, track 18 is in the parallel position so that grinder wheel 16 may be moved across blade 80 from side to side. Because different drums utilize different blade spacing arrangements, the ability to change between the parallel and perpendicular positions is important in instances where clearance between blades is an issue.

Figure 5C:
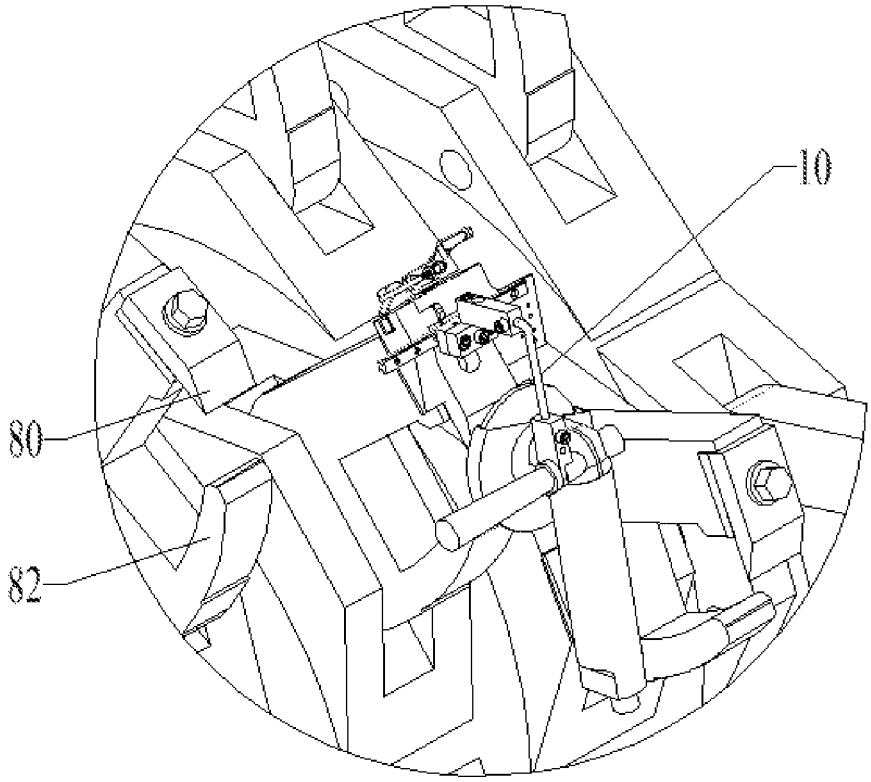
FIG. 5C is zoomed-in view of the indicated section of FIG. 5A.

Now referring to FIGS. 5A-5C, perspective views of sharpening tool 10 in use are provided. Rotary drum 84 is of a type commonly used in chippers and dozens of blades 80 and blade holders 82 are disposed upon rotary drum 84. Without removing a dull blade 80 from its position on rotary drum 84, sharpening tool 10 of the present invention may be applied to blade 80, as shown. Blade opening 66 will be placed around blade 80 and sharpening fixture 12 will securely clamp onto blade 80 using the blade clamp 20. Track 18 is then positioned as necessary to sharpen blade 80, and the sharpening may occur on site, in the field.

Although the present invention has been described in considerable detail with reference to certain preferred versions thereof, other versions would be readily apparent to those of ordinary skill in the art. Therefore, the spirit and scope of the description should not be limited to the description of the preferred versions contained herein.

What is claimed is:

1. A blade sharpening fixture for use in sharpening an angled cutting surface of a blade, said sharpening fixture comprising:

a clamp side and a slide side, wherein each of said clamp side and said slide side comprise an attachment portion that allows said clamp side to engage and move linearly relative to said slide side and a sloped surface which is sloped at an angle substantially equal to an angle of the angled cutting surface of the blade to be sharpened, and wherein said clamp side and said slide side define a blade opening shaped and dimensioned to engage the blade during sharpening;

a blade clamp for securely and removably clamping the blade within the blade opening between said clamp side and said slide side of said sharpening fixture, wherein said blade clamp comprises a latch toggle clamp;

a track attached to said sloped surface of said slide side; and a grinder connector assembly for holding a grinder in slidable relation to said track.

2. The sharpening fixture as claimed in claim 1, wherein said grinder connector assembly comprises:

a slide disposed in movable relation to said track;

an extender attached to said slide;

an arm attached to said extender; and a grinder connector dimensioned and shaped for attachment to the grinder and said arm.

3. The sharpening fixture as claimed in claim 2, wherein said arm of said grinder connector assembly is substantially L-shaped and is adjustably attached to said extender such that an adjustment of said arm allows a height of the grinder to be adjusted.

4. The sharpening fixture as claimed in claim 2, wherein said grinder connector assembly further comprises a grinder support attached to said extender.

5. The sharpening fixture as claimed in claim 2, wherein said extender is adjustably attached to said slide such that a grinding wheel of the grinder may be positioned at an angle relative to the blade.

6. The sharpening fixture as claimed in claim 1 further comprising a uni-mount attached to said grinder connector assembly, wherein said uni-mount is shaped and dimensioned to be attached to the grinder and comprises a first threaded opening, a second threaded opening, and a threaded plug, wherein said first threaded opening and said second threaded opening are each dimensioned to mate with said threaded plug and a threaded bolt extending from a handle of the grinder.

7. The sharpening fixture as claimed in claim 1, wherein said slide side of said sharpening fixture comprises a plurality of track positioning holes and at least one track bolt for holding said track in a certain position with relation to said slide side of said sharpening fixture when said track bolt is secured through said track and one of said track positioning holes.

8. The sharpening fixture as claimed in claim 7, wherein said plurality of track positioning holes comprises a first plurality of track positioning holes and a second plurality of track positioning holes disposed in perpendicular relation to said first plurality of track positing holes.

9. A blade sharpening tool for use in sharpening an angled cutting surface of a blade, said sharpening tool comprising:

a grinder comprising;

a grinding wheel;

a grinder motor adapted to rotate said grinding wheel, said grinder motor comprising at least one threaded opening therein; and a handle having a threaded bolt dimensioned to mate with said at least one threaded opening of said grinder motor; and a sharpening fixture attached to said grinder, said sharpening fixture comprising:

a clamp side and a slide side, wherein each of said clamp side and said slide side comprise an attachment portion that allows said clamp side to engage and move linearly relative to said slide side and a sloped surface which is sloped at an angle substantially equal to an angle of the angled cutting surface of the blade to be sharpened, and wherein said clamp side and said slide side define a blade opening shaped and dimensioned to engage the blade during sharpening;

a blade clamp for securely and removably clamping said clamp side and said slide side to the blade, wherein said blade clamp comprises a latch toggle clamp;

a track attached to said sloped surface of said slide side; and a grinder connector assembly for holding said grinder in slidable relation to said track such that a plane formed by a flat portion of said grinding wheel is disposed in substantially parallel relation to a plane formed by said sloped surface of said slide portion of said sharpening fixture;

wherein said grinder is securely and slidably attached to said sharpening fixture.

10. The sharpening tool as claimed in claim 9, wherein said grinder connector assembly of said sharpening fixture comprises:

a slide disposed in movable relation to said track;

an extender attached to said slide;

an arm attached to said extender; and a grinder connector attached to said grinder and said arm.

11. The sharpening tool as claimed in claim 10, wherein said arm of said grinder connector assembly of said sharpening fixture is substantially L-shaped and is adjustably attached to said extender such that an adjustment of said arm allows a height of said grinder to be adjusted.

12. The sharpening tool as claimed in claim 9, further comprising a uni-mount attached to said grinder connector assembly and said grinder motor of said grinder, wherein said uni-mount comprises a first threaded opening, a second threaded opening, and a threaded plug, wherein said first threaded opening and said second threaded opening are each dimensioned to mate with said threaded plug and said threaded bolt extending from said handle of said grinder.

13. The sharpening tool as claimed in claim 9, wherein said slide side of said sharpening fixture comprises a plurality of track positioning holes and at least one track bolt for holding said track in a certain position with relation to said slide side of said sharpening fixture when said track bolt is secured through said track and one of said track positioning holes.

14. The sharpening tool as claimed in claim 13, wherein said plurality of track positioning holes comprises a first plurality of track positioning holes and a second plurality of track positioning holes disposed in perpendicular relation to said first plurality of track positing holes.

15. A kit for forming a blade sharpening tool for use in sharpening an angled cutting surface of a blade, said kit comprising:

a grinder comprising;

a grinding wheel;

a grinder motor adapted to rotate said grinding wheel, said grinder motor comprising at least one threaded opening therein; and a handle having a threaded bolt dimensioned to mate with said at least one threaded opening of said grinder motor; and a sharpening fixture dimensioned for attachment to said grinder, said sharpening fixture comprising:

a clamp side and a slide side, wherein each of said clamp side and said slide side comprise an attachment portion that allows said clamp side to engage and move linearly relative to said slide side and a sloped surface which is sloped at an angle substantially equal to an angle of the angled cutting surface of the blade to be sharpened, and wherein said clamp side and said slide side define a blade opening shaped and dimensioned to engage the blade during sharpening, and wherein said slide side comprises:

a first plurality of track positioning holes and a second plurality of track positioning holes disposed in perpendicular relation to said first plurality of track positing holes; and at least one track bolt for holding said track in a certain position with relation to said slide side of said sharpening fixture when said track bolt is secured through said track and one of said track positioning holes;

a blade clamp for securely and removably clamping said clamp side and said slide side to the blade;

a track attached to said sloped surface of said slide side; and a grinder connector assembly for holding said grinder in slidable relation to said track such that a plane formed by a flat portion of said grinding wheel is disposed in substantially parallel relation to a plane formed by said sloped surface of said slide portion of said sharpening fixture.

16. The kit as claimed in claim 15, wherein said grinder connector assembly of said sharpening fixture comprises:

a slide disposed in movable relation to said track;

an extender attached to said slide;

an arm attached to said extender; and a grinder connector dimensioned and shaped for attachment to said grinder and said arm.

17. The kit as claimed in claim 15, further comprising a uni-mount dimensioned for attachment to said grinder connector assembly and said grinder motor of said grinder; wherein said uni-mount comprises a first threaded opening, a second threaded opening, and a threaded plug, wherein said first threaded opening and said second threaded opening are each dimensioned to mate with said threaded plug and said threaded bolt extending from said handle of said grinder.

18. A blade sharpening tool for use in sharpening an angled cutting surface of a blade, said sharpening tool comprising:

a grinder comprising;

a grinding wheel;

a grinder motor adapted to rotate said grinding wheel, said grinder motor comprising at least one threaded opening therein; and a handle having a threaded bolt dimensioned to mate with said at least one threaded opening of said grinder motor; and a sharpening fixture attached to said grinder, said sharpening fixture comprising:

a clamp side and a slide side, wherein:

each of said clamp side and said slide side comprise:

an attachment portion that allows said clamp side to engage and move linearly relative to said slide side; and a sloped surface which is sloped at an angle substantially equal to an angle of the angled cutting surface of the blade to be sharpened;

said clamp side and said slide side define a blade opening shaped and dimensioned to engage the blade during sharpening;

said slide side comprises a plurality of track positioning holes and at least one track bolt for holding said track in a certain position with relation to said slide side of said sharpening fixture when said track bolt is secured through said track and one of said track positioning holes; and said plurality of track positioning holes comprises a first plurality of track positioning holes and a second plurality of track positioning holes disposed in perpendicular relation to said first plurality of track positing holes;

a blade clamp for securely and removably clamping said clamp side and said slide side to the blade;

a track attached to said sloped surface of said slide side; and a grinder connector assembly for holding said grinder in slidable relation to said track such that a plane formed by a flat portion of said grinding wheel is disposed in substantially parallel relation to a plane formed by said sloped surface of said slide portion of said sharpening fixture;

wherein said grinder is securely and slidably attached to said sharpening fixture.

19. The sharpening tool as claimed in claim 18, wherein said grinder connector assembly of said sharpening fixture comprises:

a slide disposed in movable relation to said track;

an extender attached to said slide;

an arm attached to said extender; and a grinder connector attached to said grinder and said arm.

20. The sharpening tool as claimed in claim 19, wherein said arm of said grinder connector assembly of said sharpening fixture is substantially L-shaped and is adjustably attached to said extender such that an adjustment of said arm allows a height of said grinder to be adjusted.

21. The sharpening tool as claimed in claim 18, further comprising a uni-mount attached to said grinder connector assembly and said grinder motor of said grinder, wherein said uni-mount comprises a first threaded opening, a second threaded opening, and a threaded plug, wherein said first threaded opening and said second threaded opening are each dimensioned to mate with said threaded plug and said threaded bolt extending from said handle of said grinder.

* * * * *